US011084148B2

(12) United States Patent
Malinowski et al.

(10) Patent No.: US 11,084,148 B2
(45) Date of Patent: Aug. 10, 2021

(54) TORQUE IMPULSE WRENCH

(71) Applicant: ATLAS COPCO INDUSTRIAL TECHNIQUE AB, Stockholm (SE)

(72) Inventors: Wojtek Malinowski, Danderyd (SE); Torbjörn Rafael Sjöblom, Årsta (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 292 days.

(21) Appl. No.: 16/461,526

(22) PCT Filed: Nov. 24, 2017

(86) PCT No.: PCT/EP2017/080335

§ 371 (c)(1),
(2) Date: May 16, 2019

(87) PCT Pub. No.: WO2018/104075

PCT Pub. Date: Jun. 14, 2018

(65) Prior Publication Data

US 2019/0344407 A1 Nov. 14, 2019

(30) Foreign Application Priority Data

Dec. 5, 2016 (SE) ..... 1630285-3

(51) Int. Cl.
*B25B 21/02* (2006.01)
*B25F 5/02* (2006.01)

(52) U.S. Cl.
CPC ..... *B25B 21/02* (2013.01); *B25F 5/02* (2013.01)

(58) Field of Classification Search
CPC ..... B25B 19/00; B25B 21/00; B25B 21/002; B25B 21/004; B25B 21/007; B25F 1/00; B25F 3/00; B25F 5/001
See application file for complete search history.

(56) References Cited

U.S. PATENT DOCUMENTS 5,092,410 A 3/1992 Wallace et al.
6,186,879 B1 2/2001 Ericsson
(Continued)

FOREIGN PATENT DOCUMENTS

WO 9114541 A1 10/1991
WO 2011141205 A1 11/2011
(Continued)

OTHER PUBLICATIONS

International Search Report (ISR), Written Opinion, and International Preliminary Report on Patentability (IPRP) dated Feb. 2, 2018 issued in International Application No. PCT/EP2017/080335.

*Primary Examiner* — Lee D Wilson
(74) *Attorney, Agent, or Firm* — Holtz, Holtz & Volek PC

(57) ABSTRACT

An impulse wrench includes a housing, an electric motor with a rotor, a hydraulic pulse unit with an inertia drive member and an output shaft, and a coupling rigidly connecting the rotor to the inertia drive member to form an integrated rotating structure. The coupling includes a male coupling portion on the inertia drive member and a female coupling portion on the rotor, such that the male coupling portion is received in the female coupling portion to form the coupling. The male and female coupling portions have external and internal threaded sections, respectively, where an axial clamping force is accomplished at relative rotation of the rotor and the inertia drive member. The male coupling portion and the female coupling portion are provided with mating conical surfaces which are brought together by the axial clamping force to form a rigid connection between the rotor and the inertia drive member.

2 Claims, 1 Drawing Sheet

(56) References Cited

U.S. PATENT DOCUMENTS

| | | | | |
|---|---|---|---|---|
| 2013/0056237 | A1 | 3/2013 | Söderlund | |
| 2014/0124228 | A1 | 5/2014 | Kviberg et al. | |
| 2017/0028537 | A1* | 2/2017 | McClung | B25B 13/06 |
| 2017/0246732 | A1* | 8/2017 | Dey, IV | G01D 5/2006 |
| 2019/0344407 | A1* | 11/2019 | Malinowski | B25B 21/02 |

FOREIGN PATENT DOCUMENTS

| | | | |
|---|---|---|---|
| WO | 2013000725 | A1 | 1/2013 |
| WO | 2015182513 | A1 | 12/2015 |

* cited by examiner

TORQUE IMPULSE WRENCH

The invention relates to a torque impulse wrench, particularly a portable torque impulse wrench comprising a housing supporting an electric motor with a rotor, a pulse unit with an output shaft, and a coupling connecting the motor rotor to the pulse unit.

There is previously described an impulse wrench of the above type wherein the rotor of the motor and the inertia drive member of the impulse unit are rigidly interconnected via a coupling to form an integrated rotating structure. Such a rigid connection between the motor rotor and the inertia drive member of the pulse unit has made it is possible to support the entire integrated rotating structure of the motor rotor and the pulse unit in just two bearings. The object of this arrangement is to make the impulse wrench more compact and lighter to thereby improve the ergonomic features of the wrench.

This type of impulse wrench having the motor rotor and the pulse unit forming an integrated structure and supported in just two bearings is described in the published patent application PCT-EP 2012/061317.

This previously described impulse wrench suffers from two identified drawbacks caused by the coupling connecting the motor to the pulse unit, whereof a first drawback concerns the poor rigidity of the coupling that may cause misalignment between the two parts of the integrated rotating structure, whereas the other drawback is related to a feature of the coupling design which makes it impossible to remove the pulse unit from the housing for service without removing the motor rotor and parts of the housing as well.

As to the first mentioned disadvantage of the previously described coupling between the motor rotor and the inertia drive member of the pulse unit the two-bearing arrangement requires a very rigid rotating structure to maintain a perfect and fully efficient operation of the impulse wrench at extended operation periods. In impulse wrenches it is detrimental to the pulse transmission if the coupling between the motor rotor and the inertia drive member of the pulse unit is not completely rigid, i.e. without any play or instability. This is due to the fact that the motor rotor together with the inertia drive member forms an active part of the total rotating inertia that creates the energy of each torque impulse delivered by the wrench. A play in the connection between the motor rotor and the inertia drive member causes a reduced and less distinct torque peek.

Regarding the rigidity of the coupling between the motor rotor and the inertia drive member of the pulse unit it is crucial for obtaining optimum efficiency of the wrench that the coupling is absolutely rigid and does not enable any kind of play, radial, axial nor rotational. In the two-bearing integrated motor-pulse unit arrangement described in the above publication there is employed a combined hexagon and splines coupling clamped axially by a central screw. This type of connection does not guarantee that any kind of play may occur, because some very small initial play is inevitable to enable assembly of the coupling, and the central screw applies an axial clamping force only which does not prevent undesired radial and/or rotational play to occur during operation of the wrench. The initially very small play may easily be enlarged to an undesired level.

The above mentioned drawback related to the awkward and time consuming dismantling of the wrench at pulse unit service occasions is caused by the fact that the central screw axially clamping the coupling together has to be removed for enabling removal of the pulse unit from the wrench housing. The screw is accessible from inside the motor rotor only, which means that for enabling removal the pulse unit at service occasions the motor as well as the rear bearing has to be removed from the housing. This means an awkward and time consuming extra work which will be an extra service cost for the wrench operator.

It is object of the invention to provide an impulse wrench having a housing supporting an electric motor with a rotor connected to the inertia drive member of a pulse unit, wherein the delivered torque impulses are guaranteed optimum efficiency by a connection between the motor rotor and the inertia drive member of the pulse unit that prevents any play to occur between the motor rotor and the pulse unit.

It is a further object of the invention to provide an impulse wrench having a housing supporting an electric motor with a rotor connected to the inertia drive member of a pulse unit, wherein the connection between the motor rotor and the pulse unit enables removal of the pulse unit from the housing without requiring disassembling and/or removal of the motor from the housing.

Still further objects and advantages of the invention will appear from the following specification and claims.

A preferred embodiment of the invention is described below with reference to the accompanying drawings.

In the drawings

Figure 1:
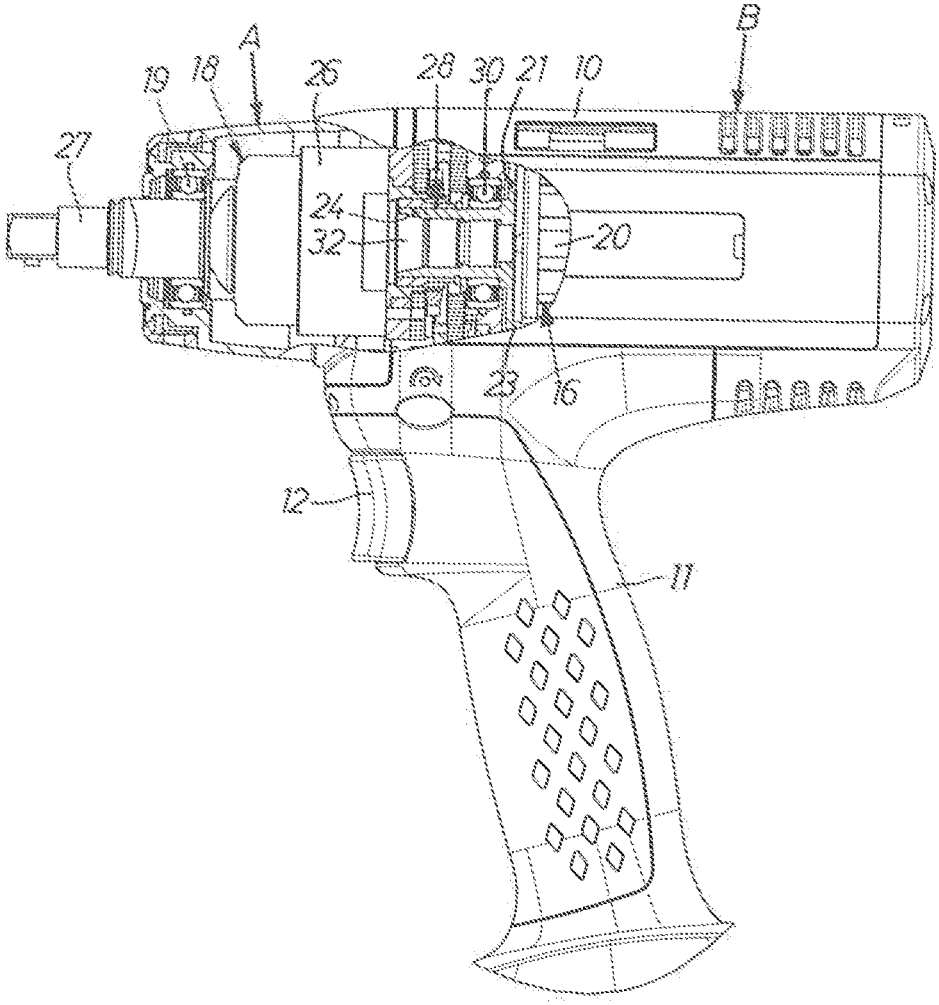
FIG. 1 shows a side view, partly in section, of an impulse wrench according to the invention.
Figure 2:
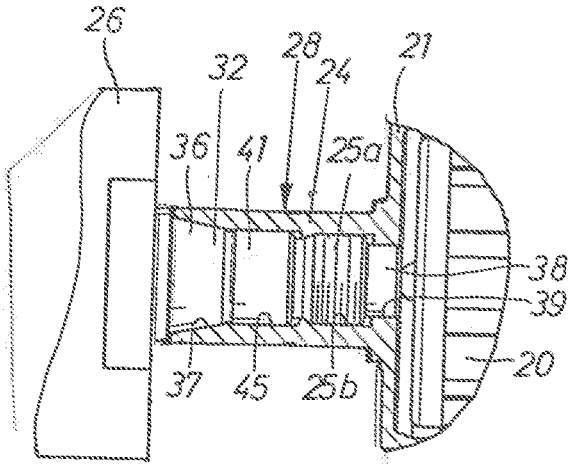
FIG. 2 shows, on a larger scale, a detail view of a coupling comprised in the impulse wrench in FIG. 1.

The impulse wrench shown in the drawing figures comprises a housing 10 having a handle 11 with a power control trigger 12 and a power receiving means connected to for instance an electric mains or a replaceable battery unit. The housing 10 includes a rear section B and a front section A, wherein the rear section B encloses an electric motor 16, whereas the front section A encloses a hydraulic pulse unit 18. The front section A supports a forward ball bearing 19 supporting the pulse unit 18.

The pulse unit and the motor are not described in further detail since they are of a similar design as those described in the above mentioned patent application PCT-EP 2012/061317.

The motor 16 comprises a central non-rotating stator 20 with power supplied windings, and a rotor 21 formed by a hollow cylindrical portion 23 surrounding the stator 20 and a forwardly extending female coupling portion 24. The latter is arranged to transfer the motor torque to the pulse unit 18 via a coupling 28 described in further detail below.

The pulse unit 18 comprises a motor torque receiving inertia member 26 and an output shaft 27, wherein the latter is intermittently coupled to the inertia member 26 via a non-illustrated pulse generating mechanism. The output shaft 27 is adapted to receive a nut socket for engaging a screw joint to be worked. The inertia drive member 26 is formed with a rearwardly extending co-axial coupling portion 32 arranged to be received in and cooperate with the female coupling portion 24 of the rotor 21 to form the coupling 28.

The pulse unit is of a previously known and described design and is, therefore, not described in further detail. See for instance patent publication WO 91/14541.

As mentioned above the female coupling portion 24 of the motor rotor 21 and a male coupling portion 32 of the inertia drive member 26 form together the coupling 28, whereby the coupling 28 is intended to form a rigid connection between the rotor 21 and the inertia drive member 26, such that the rotor 21 and the inertia drive member 26 form an integrated rotating structure. This structure is supported relative to the housing 10 in two axially spaced ball bearings 30 and 19, namely the forward bearing 19 located at the output shaft 27 and a rear bearing 30 located at the coupling 28. Accordingly, the forward bearing 19 supports not only the output shaft 27 but the front end of the whole integrated structure together with the rear bearing 30.

So, the coupling 28 comprises a male coupling portion 32 located in a co-axial disposition on the inertia drive member 26 and a female coupling portion 24 located in a co-axial disposition on the motor rotor 21, wherein the male coupling portion 32 is adapted to be received in the female coupling portion 24 to form the coupling 28. The male coupling portion 32 is provided with an external threaded section 25*a* adapted to engage a mating internal threaded section 25*b* on the female coupling portion 24 thereby forming a thread connection 35 between the rotor 21 and the inertia drive member 26. The thread connection 34 is intended to accomplish an axial clamping force to unit the inertia drive member 26 and the motor rotor 21.

The male coupling portion 32 is formed with an outer conical surface 36 intended to cooperate with a mating inner conical surface 37 on the female coupling portion 24 thereby forming a rigid stabilizing and locking connection between the rotor 21 and the inertia drive member 26. The conical surfaces 36,37 are located closer to the pulse unit 18 than the thread connection 34, which means that the thread connection 34 executes a pulling force and a binding action between the conical surfaces 36,37.

There are provided two axially spaced guide and support sections between the male and female coupling portions 24,32, namely a first guide and support section comprising an external cylindrical guide surface 38 located at extreme end the male coupling portion 32 and arranged to cooperate with the internal cylindrical guide surface 39 in the female coupling portion 24. A second guide and support section comprising a cylindrical support surface 41 located on the male coupling portion 32 between the threaded section 25*a* and the conical surface 36 and arranged to cooperate with a an inner cylindrical surface 45 in the female coupling portion 24. The centrally located thread connection 34 together with the radial support obtained by interacting surfaces 38,39 of the guide and support surfaces 38,39,41,45 will ensure an accurate and true engagement between the conical surfaces 36,37, and make the latters form a coupling having a rigid binding effect between of the male and female coupling portions 32,24. In contrast to other types of connection between the rotor 21 and the inertia drive member 26, like splines or hexagonal couplings, the coupling 28 according to the invention connecting the inertia drive member 26 and the motor rotor 21 is completely play free and will sustain play free even at extended service life of the wrench. This means a sustained optimum impulse generation and power output of the wrench.

By the above described coupling 28 including the means for centralizing and locking the rotor 21 and the inertia drive member 26 there is obtained not only a very stable and play free connection between the two parts but brings the advantage of facilitating service operations on the pulse unit 18. Due to the central location of the thread connection 34 the pulse unit 18 may be separated from the motor rotor 21 and removed from the housing 10 without loosening or removing any other parts of the motor and the housing 10. At removal of the pulse unit 18 the front section A of the housing 10 including the forward bearing 19 may be disconnected from the rest of the housing 10 and the inertia drive member 26 may be disengaged from the rotor 21 by loosening the thread connection 34. To prevent the rotor 21 from rotating when loosening the thread connection 34 there are provided a couple of non-illustrated openings in the housing 10 and in the periphery of the rotor 21 which allow one or more lock pins to be inserted to lock the rotor 21 against rotation relative to the housing 10.

It is to be noted that the invention is not limited to the very example described and illustrated above but may be freely varied within the scope of the claims.

The invention claimed is:

1. An impulse wrench comprising a housing, an electric motor with a rotor, a hydraulic pulse unit with an inertia drive member and an output shaft, and a coupling rigidly connecting the rotor to the inertia drive member to form an integrated rotating structure, wherein:

the coupling comprises a male coupling portion on the inertia drive member and a female coupling portion on the rotor, the male coupling portion is arranged to be received in the female coupling portion to form the coupling, the male coupling portion has an external threaded section, and the female coupling portion has an internal threaded section, wherein an axial clamping force is accomplished at relative rotation of the rotor and the inertia drive member, and the male coupling portion and the female coupling portion are provided with mating conical surfaces which are brought together by the axial clamping force to form a rigid connection between the rotor and the inertia drive member.

2. The impulse wrench according to claim 1, wherein the male coupling portion is provided with an external cylindrical guide surface at its extreme end, and the female coupling portion is provided with an internal cylindrical guide surface adapted to receive the external cylindrical guide surface on the male coupling portion so as to form a radial support between the rotor and the inertia drive member.

* * * * *